United States Patent [19]

Daniels

[11] Patent Number: 4,922,941

[45] Date of Patent: May 8, 1990

[54] CRUTCH HAVING A CHANGEABLE ARMPIECE

[76] Inventor: Charles Daniels, Pine Hill Rd., Pleasant Valley, N.Y. 12569

[21] Appl. No.: 412,343

[22] Filed: Sep. 26, 1989

[51] Int. Cl.[5] ..... A61H 3/02

[52] U.S. Cl. ..... 135/71; 135/73; 135/66; 135/68; 135/DIG. 9; 403/328

[58] Field of Search ..... 135/65, 66, 68, 71, 135/73, 69, 72, DIG. 9, 76; 403/328

[56] References Cited

U.S. PATENT DOCUMENTS

| | | | |
|---|---|---|---|
| 2,811,978 | 11/1957 | Russell | 135/65 |
| 2,932,047 | 4/1960 | Johnston | 403/328 X |
| 4,047,821 | 9/1977 | Hoke et al. | 403/328 X |
| 4,272,087 | 6/1981 | Rohm | 403/328 X |
| 4,733,682 | 3/1988 | Ellena | 135/65 X |

FOREIGN PATENT DOCUMENTS

| | | | |
|---|---|---|---|
| 118026 | 8/1918 | United Kingdom | 135/73 |

*Primary Examiner*—David A. Scherbel
*Assistant Examiner*—Lan Mai
*Attorney, Agent, or Firm*—Terry M. Gernstein

[57] ABSTRACT

A crutch includes a monolithic frame and has at least two different arm-engaging pieces associated therewith. The arm-engaging pieces are releasably attached to the frame by a locking mechanism and one of the pieces is a D-shaped forearm-engaging element and another of the pieces is a U-shaped armpit-engaging element. The arm-engaging pieces include pads in one form of the invention.

7 Claims, 2 Drawing Sheets

CRUTCH HAVING A CHANGEABLE ARMPIECE

TECHNICAL FIELD OF THE INVENTION

The present invention relates to the general art of supports, and to the particular field of crutches.

BACKGROUND OF THE INVENTION

Many disabled people require the use of a crutch for walking. Most crutches include a footpiece having a crutch tip at one end and upwardly diverging bows at the other end with an armpiece and a handpiece extending across the bows. The armpiece is inserted beneath the user's arm near the armpit, and the user leans on the crutch as he or she walks.

It has been found that, even if the armpiece includes a pad, extended use of the crutch can be quite irritating, and even painful, to the user. This is especially the case where the person will make extended use of the crutch, such as if the person has cerebral palsy or the like, and if the person is a child who may not be strong enough to support themself on the handpieces of the crutch.

Accordingly, the art has included crutches which are designed to alleviate such discomfort. See, for example, the crutches disclosed in U.S. Pat. Nos. 2,197,279, 2,861,582 and 3,213,896.

While such crutches do achieve the result of relieving discomfort by moving the armpiece, there are still drawbacks. Principal among such drawbacks is the lack of versatility associated with such crutches. For instance, there may be times when it is desired to have the armpiece located beneath the user's armpit instead of around the user's forearm. In such a case, crutches such as are disclosed in the just-mentioned patents are not useable.

Accordingly, there is a need for a crutch which is versatile and is adaptable to a variety of uses and which can be used either in a forearm-contacting manner or in an armpit-contacting manner.

OBJECTS OF THE INVENTION

It is a main object of the present invention to provide a crutch which is versatile.

It is another object of the present invention to provide a crutch which is versatile and is adaptable to a variety of uses.

It is another object of the present invention to provide a crutch which is versatile and is adaptable to a variety of uses and which can be used either in a forearm-contacting manner or in an armpit-contacting manner.

SUMMARY OF THE INVENTION

These, and other, objects are achieved by a crutch that has a locking mechanism that works in conjunction with either of at least two different arm-engaging assemblies. One assembly works in a forearm-contacting mode and the other assembly works in an armpit-contacting mode.

In this manner, the crutch of the present invention is amenable to a variety of operational modes, and the user has a choice of which mode is most desirable. If, for some reason, the user's forearm is not available for use with the crutch, the arm-engaging assemblies are simply changed to an armpit-engaging assembly.

BRIEF DESCRIPTION OF THE DRAWING FIGURES

DETAILED DESCRIPTION OF THE PREFERRED EMBODIMENT OF THE INVENTION

Figure 1:
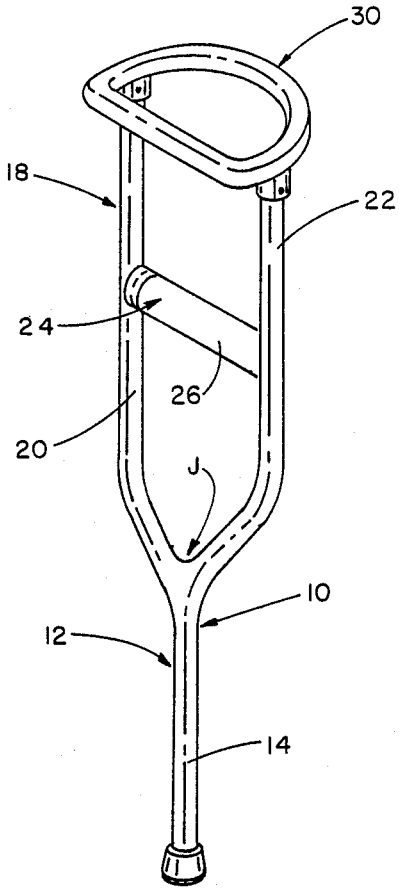
FIG. 1 is a perspective view of a crutch embodying the present invention in a forearm-engaging configuration.
Figure 2:
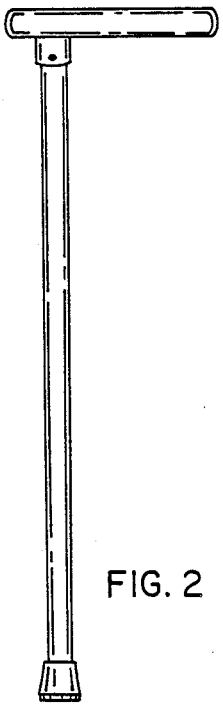
FIG. 2 is a side elevational view of the crutch shown in FIG. 1.

Shown in FIGS. 1 and 2 is a crutch 10 of the type used by an invalid to assist walking, standing or the like. The crutch 10 includes a monolithic frame 12 that has a footpiece 14 on which a crutch tip 16, of rubber or the like, is mounted one end thereof, and which has a Y-shaped bow element section 18 on the other end thereof. The bow element section includes two bows 20 and 22 attached at one end thereof to the footpiece and diverging upwardly to be spaced apart from each other at the other ends thereof.

The crutch also includes a handgrip element. 24 extending between the bows and which is attached to such bows, the handgrip element also includes a pad 26 encircling such element.

Figure 4:
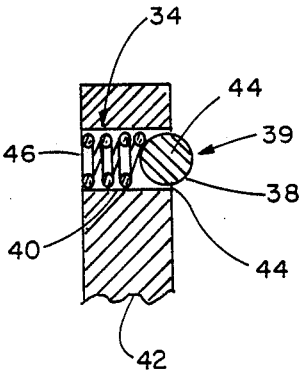
FIG. 4 is an exploded perspective view of a forearm-engaging element.
Figure 5:
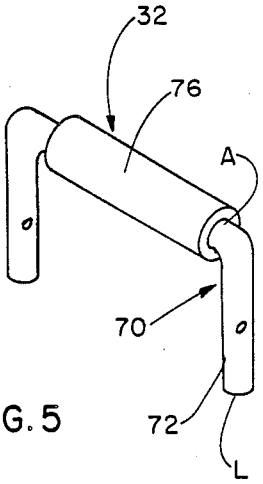
FIG. 5 is a perspective view of an armpit-engaging element.

The crutch 10 is amenable to being used in a forearm-engaging mode or in an armpit-engaging mode, and thus includes means for using the above-described crutch frame in combination with a forearm-engaging element 30 or in combination with an armpit-engaging element 32 shown in FIG. 5. This means includes a releasable locking mechanism 34, best shown in FIGS. 3 and 4.

The locking mechanism 34 is located near the top end 35 of each of the bow elements, and these top ends are hollow to accommodate such locking mechanism. Each locking mechanism includes a hole 38 defined in the associated bow element near the top end thereof, and a hollow tubular support element 40 mounted inside the bow element to extend across the bore 42 defined in the bow element and which is attached to the bow element inside surface. A ball 44 is located inside the support element 40 and is sized to have a diameter larger than the diameter of the hole 38 so that it can be jammed against the inner surface of the bow element adjacent to that hole 38. As can be seen in FIG. 4, the inner diameter of the tubular element 34 is approximately that of the ball diameter so the ball can slide into and out of the element as indicated by the double-headed arrow 39. Thus, the inner diameter of the tubular element 34 is slightly larger than the diameter of the hole 38 and an overhang 44 is defined against which the ball is biased by a spring 46. The spring 46 has one end thereof seated against the inner surface of the bow and the other end thereof seated against the ball. The spring constant is selected so that the ball can be moved back into the support element 34 against the bias of the spring by hand pressure.

Figure 3:
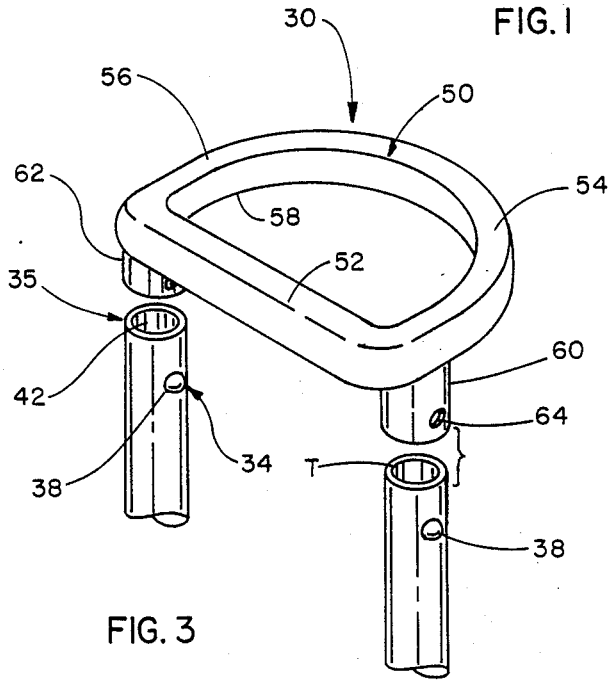
FIG. 3 is a cutaway elevational view of a portion of the crutch of the present invention showing a portion of a locking mechanism thereof.

As discussed above, the crutch of the present invention includes a forearm-engaging element 30. This element is monolithic and includes a D-shaped arm engaging element 50 having a linear back portion 52 and an arcuate forward portion 54. The element 50 includes a top surface 56 and a lower surface 58, with the lower surface being presented towards the frame element and including two hollow tubular legs 60 and 62 each having an inside diameter that is greater than the outside diameter of the bow element top ends so that these top ends can be received inside the tubular legs as best indicated in FIG. 3 to support the element 30 on the frame 18.

Each of the legs has a hole, such as hole 64 in leg 60 that has a diameter equal to the diameter of the hole 38, and is located on the tubular leg to be concentric with that hole 38 when the element 30 is seated on the frame element as shown in FIGS. 1 and 2. When the holes 38, 62 and 64 acre all concentrically oriented, the balls 44 will extend through both concentric holes on each leg and bow to lock the frame to the arm piece.

Should the user desire to use the crutch in an armpit-engaging mode, the user simply forces the balls 44 back into the tubular elements 34 to release the coupling of the legs 60 and 62 to the associated bows, and pulls the element 30 off of the frame. The user then attaches the armpit-engaging element 32 to the bows in place of the forearm-engaging element 30. The armpit-engaging element 32 is best shown in FIG. 5, and includes a U-shaped support element 70 having long legs 72 and a bight section 74 having a pad 76 encircling it.

Each of the long legs is approximately one-third as long as the total length of the bow elements as measured from the top ends T thereof to the junction J thereof, with the length of the long legs being measured from the bight section to the lower ends L thereof. Each long leg includes a hole 62' and 64' which is sized to be equal to the holes 62 and 64 and which is each placed to be concentric with the holes 38 of the bow elements when the element 32 is seated on the frame. The seating of the element 32 on the frame is similar to the seating of the element 30 on the frame as above described, and thus will not be described. The additional length of the long legs 72 is required to move the bight section into a location to engage a user's armpit and yet be still securely supported on the frame element.

Figure 8:
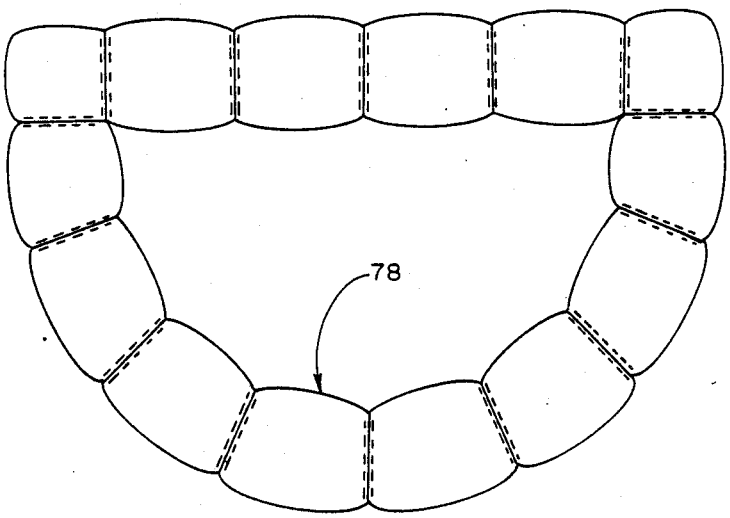
FIG. 8 is a top plan view of the forearm-engaging element of the FIG. 6 embodiment.
Figure 7:
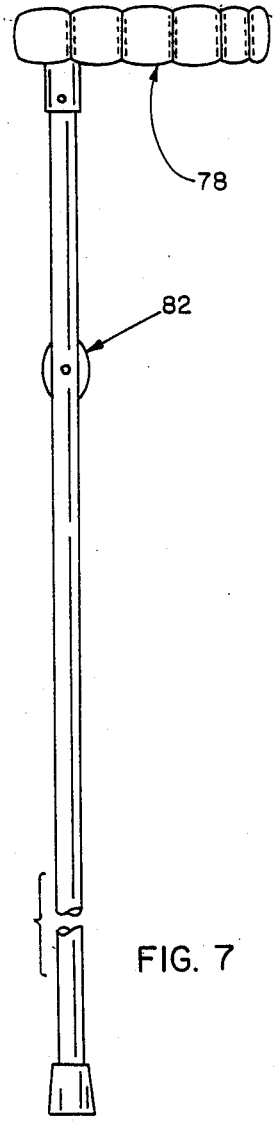
FIG. 7 is a side elevational view of the crutch shown in FIG. 6.
Figure 6:
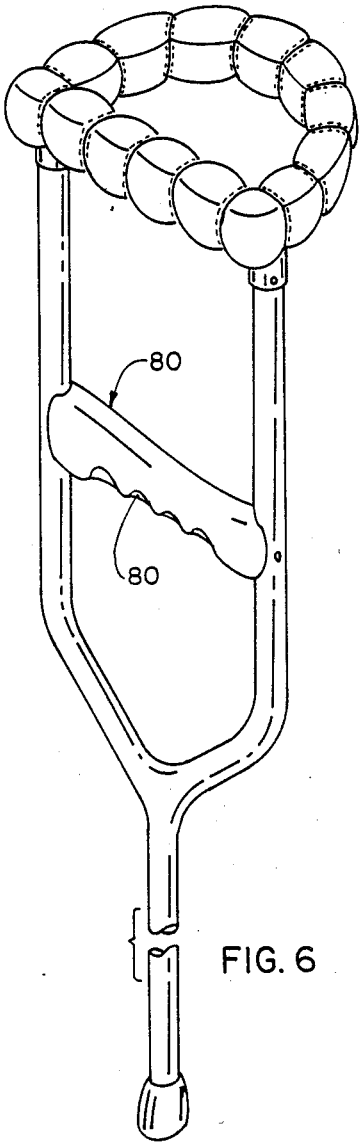
FIG. 6 is a perspective view of another form of the crutch of the present invention.

Both of the arm-engaging elements can include scalloped padding 78 such as shown on the forearm-engaging element in FIGS. 6, 7 and 8. The pad 26 can also be scalloped to include finger grips 80 such as shown for pad 82 in FIG. 6. Such padding will make the crutch even more comfortable to use.

It is understood that while certain forms of the present invention have been illustrated and described herein, it is not to be limited to the specific forms or arrangements of parts described and shown.

I claim:

1. A crutch comprising:

(A) a monolithic frame having (1) a footpiece, (2) a crutch tip on said footpiece in position to engage a support surface, (3) two bows each attached at one end to said footpiece and having a second end spaced from said footpiece to form a Y-shape for said frame with said bows diverging upwardly from a junction at said footpiece to said second ends, each bow having a length as measured between said junction and the second end, said second ends each being hollow and having an outer diameter, and (4) a handgrip element attached to each of said bows;

(B) a releasable locking mechanism on said frame which includes (1) a hole defined in each bow near the second end of such bow, (2) a hollow tubular support element mounted inside each of said bows near the second ends of such bows and extending across the bow in which it is mounted, said hollow tubular support elements having a longitudinal axis that is aligned with the center of the hole in the bow, (3) a ball mounted in each tubular support element, said ball having a diameter larger than the diameter of the hole in the bow, and (4) a spring located in each tubular support element and engaging the ball in each tubular element to bias that ball outwardly of one end of the support element and into engagement with the bow adjacent to the hole in the bow; and (C) a monolithic arm piece which includes (1) an arm-engaging element, (2) two tubular legs each attached at one end to said arm-engaging element and extending away from said arm-engaging element, each of said tubular legs having an inner diameter which is larger than the outer diamter of said hollow tubular bow second ends and being located to releasably receive said bow second ends therein and a length as measured between said one end and a second end, (3) a hole defined in each hollow leg, each said leg hole being sized and positioned to be concentric with said hole defined in the bow second end on which the leg is mounted, said ball being sized to partially extend through the concentric holes to releasably lock said arm-engaging element to said frame bows.

2. The crutch defined in claim 1 wherein said armpiece is D-shaped and is positioned on said frame to engage a user's forearm when that user grasps the handgrip element.

3. The crutch defined in claim 2 further including a scalloped cushion on said D-shaped armpiece.

4. The crutch defined in claim 1 wherein said armpiece is U-shaped and is sized and located to engage a user's armpit when that user grasps the handgrip element, said U-shaped element having two long legs and a bight element, with each of the long legs having a length as measured between said bight element and a second end of the long leg.

5. The crutch defined in claim 1 further including a pad on said handgrip element.

6. The crutch defined in claim 5 wherein said pad includes finger scallops.

7. The crutch defined in claim 4 wherein the length of each of the long legs is approximately one-third of the length of said bow elements.

* * * * *